United States Patent [19]

Thern et al.

[11] Patent Number: 4,660,023

[45] Date of Patent: Apr. 21, 1987

[54] LOCALITY SUPERVISION SYSTEM

[76] Inventors: Rolf A. B. Thern, Lillhersbyvagen 8, S-191 45 Sollentuna; Hans G. Holmgren, Bergsatersvagen 12, S-191 40 Sollentuna, both of Sweden

[21] Appl. No.: 634,450

[22] Filed: Jul. 25, 1984

[51] Int. Cl.[4] ..... G08B 19/00

[52] U.S. Cl. ..... 340/521; 340/531; 340/533; 340/538; 340/539

[58] Field of Search ..... 340/521, 506, 525, 531, 340/533, 534, 538, 539; 455/67, 9, 49, 53, 54, 229

[56] References Cited

U.S. PATENT DOCUMENTS

| | | | |
|---|---|---|---|
| 3,133,276 | 5/1964 | Miller et al. | 340/538 |
| 3,764,984 | 10/1973 | McCartney | 340/539 |
| 3,909,826 | 9/1975 | Schildmeier et al. | 340/539 |
| 4,019,139 | 4/1977 | Ortega | 340/539 |
| 4,091,366 | 5/1978 | Lavallee | 340/539 |
| 4,101,872 | 7/1978 | Pappas | 340/539 |
| 4,290,056 | 9/1981 | Chow | 340/538 |

FOREIGN PATENT DOCUMENTS

| | | |
|---|---|---|
| 479928 | 2/1938 | United Kingdom . |
| 2009478 | 6/1979 | United Kingdom . |
| 2029957 | 3/1980 | United Kingdom . |

*Primary Examiner*—Donnie L. Crosland

*Attorney, Agent, or Firm*—Frishauf, Holtz, Goodman & Woodward

[57] ABSTRACT

A supervising system for a group of localities like homes. A local equipment including a transmitter, a receiver and an emergency detector is installed in each locality. Identification signatures are exchanged continuously on a common transmission channel between the equipments by a signalling procedure which is initiated repeatedly. Any equipment may start the procedure and generates thereafter internally all control signals for transmitting its own signature and receiving signatures from the others. All equipments indicate alarm for a locality when its signature is not received correctly. An emergency condition modifies the signature which is transmitted. All equipments have the same system status and can each operate independently of other equipments.

12 Claims, 3 Drawing Figures

LOCALITY SUPERVISION SYSTEM

This is a continuation of International Patent Application No. PCT/SE82/00404, filed in Sweden on Nov. 26, 1982.

The invention is directed to a system for supervising a group of two or several localities being preferably residences, said system comprising in each locality a local equipment which is connected to the remaining local equipments of the group and which is provided with an indication device having indicator means for visual and/or audial indication of the state of supervision in the remaining localities, an alarm detector which is connected to said indication device for generating an alarm indicative signal when sensing a movement, a development of smoke, an intrusion or a corresponding event, a switch for activating/inactivating the supervisory function of said detector, and a power source for current supply of the local equipment. It is obvious that the system according to the invention is just as well useful in homes in apartment houses as in homes in private houses.

A system of the type mentioned above may be used for many different purposes. Accordingly it is possible to use the system for detecting an unauthorized intrusion into a locality, that is as a burglar alarm system, but also for detection of that actions which are desireable really takes place, for example that a person living alone moves around in her residence, i.e. as a so called security alarm. Also combinations of said uses are possible. However, in order to clarify the following description the same will be on the first hand directed to the burglar alarm systems for use in private homes, in vacation houses and/or apartments.

Burglar alarms for private use are previously known in a large number of realizations. Mainly two types of systems are available, that is firstly systems which are connected to a operator-controlled alarm center and secondly systems which are limited to the locality which is supervised.

For said first type of system a service is purchased from said alarm center. This brings about high operative costs for such a system and is therefore in practice of limited interest only for private use.

In said second type of system an alarm is initiated by the fact that a horn or a bell provided in connection with the locality starts to sound. This aims firstly to obtain a frightening effect which makes the intruder to take off and secondly to call for attendance from neighbors, who may then call for help from the police or corresponding watchmen. The effectiveness of such a system is totally dependent on the degree of spontaneous participation by the neighbors. However, due to the fact that the market during the past years has offered a large number of systems of this type and of a varying technical quality, having the concequence of frequently appearing false alarms, the respect from both neighbors and intruders for this type of a system has become undermined. For this reason the situation of today is that the first thought of a neighbor when confronted with a sounding horn is more like "just another false alarm". Having this knowledge an intruder may allow himself to continue his "work" calmly. To increase again, in the prevailing situation the respect for such systems seems not possible beyond any doubts. It may be observed that false alarms is a most significant problem also in systems which are connected to an alarm center and the statistics on alarms which are forwarded to the police have shown that 97–98% of the total number of said alarms are false. It goes without saying that this situation may have a negative influence on the priority with which the police may attend to these alarms. In turn this has a negative influence on the effectiveness of the alarm systems of this type.

A further drawback of said second type of burglar alarms systems using the frightening effect is that a frightened intruder may cause a lot of damage as a revenge before leaving the place and may even hurt persons coming in his way.

From the U.S. Pat. No. 3,133,276 a burglar alarm system is previously known which provides for interconnection between a group of stations to be protected and in which a so called alarm switch is triggered at all other stations of a group of stations upon intrusion at anyone of the stations of the group. Disregarding the fact that this burglar alarm system is based on a technology which belongs to a past state of technical development, each station must be connected to each remaining station by means of two separate signal lines. This means that the installation of such a system will demand a significant amount of work and correspondingly high costs. Further drawbacks are that the technical operation of the system must be checked manually and that one single station initiates the indications at all remaining stations via separate signal lines, which means that the indications given at the respective stations will depend upon a separate signal line and effect the security of indication. The GB patent specification No. 479.928 discloses an electric alarm system of a realization which may be compared with said U.S. patent because it uses as well a great number of separate signal lines and is based on oldfashioned technology. The GB patent application No. 2.029.057 discloses an alarm apparatus in which a plurality of detector stations are connected to a common monitoring station. Because of the fact that all indications appear at one and the same place, that is at the monitoring station, this alarm apparatus is of a type which differs from the invented supervision system as disclosed in the introduction of this description. The main drawbacks of such a centralized system are that all detector stations will be set out of function in case the monitoring system is damaged and that an operator must be at hand regularly at the monitoring station.

The object of invention is to provide a system in which the drawbacks with respect to costs and apparatus of prior art systems have been eliminated and in which the security of the indications appearing in the different localities has been significantly improved and thereby substantially reduce the frequency of unnecessary calls to the police or other watchmen service in case a false alarm is initiated in anyone of the localities.

This object of invention is obtained by means of a system of the type mentioned in the introduction and which according to the invention is characterized in that all indication devices which are comprised in the system and which are situated in different localities have one and the same construction and are connected to a common transmission channel, that each indication device comprises an alterable individualization circuit for generating a locality signature signal, which is separable on said common transmission channel, that the indication devices are continuously activated for identifying each other mutually and repeatedly by transmitting/receiving the respective locality signature signals via said common transmission channel, that each indication device has means for transmitting/receiving independently of the remaining indication devices, said means comprising an oscillator of accurate frequency for controlling the operation of the indication device, a transmitter for transmitting the locality signature signal of the indication device and a receiver for receiving the respective locality signature signals from the remaining indication devices, and circuit means being controllable by said receiver for influencing, when a correct locality signature signal is not received, said indicator means to give a corresponding locality signature indication, and that each indication device further comprises a coupling means for influencing the transmission of the locality signature signal dependent on said alarm indicative signal when said supervisory function has been activated.

The invented system shows in comparison with prior art a number of important advantages with respect to operation, installation and manufacture. The fact that the indication devices have all one and the same construction means simplification and cost reduction of manufacture. The necessary individual modification of each indication device for defining its signature signal may be obtained by a simple manual coupling, for example by means of an electrical plug which provides a connection between two circuits and which may be put into position at the installation. The use of one single transmission channel simplifies and reduces the costs of installation. The fact that the indication devices are continously activated means that an automatical function test of the indication devices and the signal channel goes on continuously. If an indication device or the channel should break down such an event will instantly be indicated by the remaining indication devices. As long as one indication device is still in operation it may indicate the status of the system and specifically the status of each local equipment. As a consequence the system may not be made inoperable by a sabotage of a single monitoring equipment.

The operation of the indication device in each locality is independent of the operation of other indication devices in the remaining localities and each indication device comprises its own receiver for receiving and evaluating said locality signature signals and all separate receivers uses one and the same signal source of information, that is the common channel. As a consequence the indications by the respective indication devices are of equal value and the indications by two independent indication devices may be used for checking the correctness of a given alarm indication. For example, when the invented supervision system has been installed in a group of private homes, two neighbors having observed an alarm indication on their respective indication devices may check these independent indications by first contacting each other on telephone before the police is called for. The attendance to an alarm indication is based on a cooperation which has been established in beforehand within the group, and therefore it may be expected or arranged that two neighbors contacting each other in this manner together have a reasonable good knowledge about the persons living in the house which is alarmed, that is if the persons are not at home or in fact are at home and accidentally have been cought by their own activated local equipment. A cooperation of this type together with the continuously running automatical function test of the supervision system will allow for a significant decrease of said high percentage of forwarded false alarms and stimulate an improved attendance to appearing alarms from the police force.

DESCRIPTION OF THE PREFERRED EMBODIMENT

Figure 1:
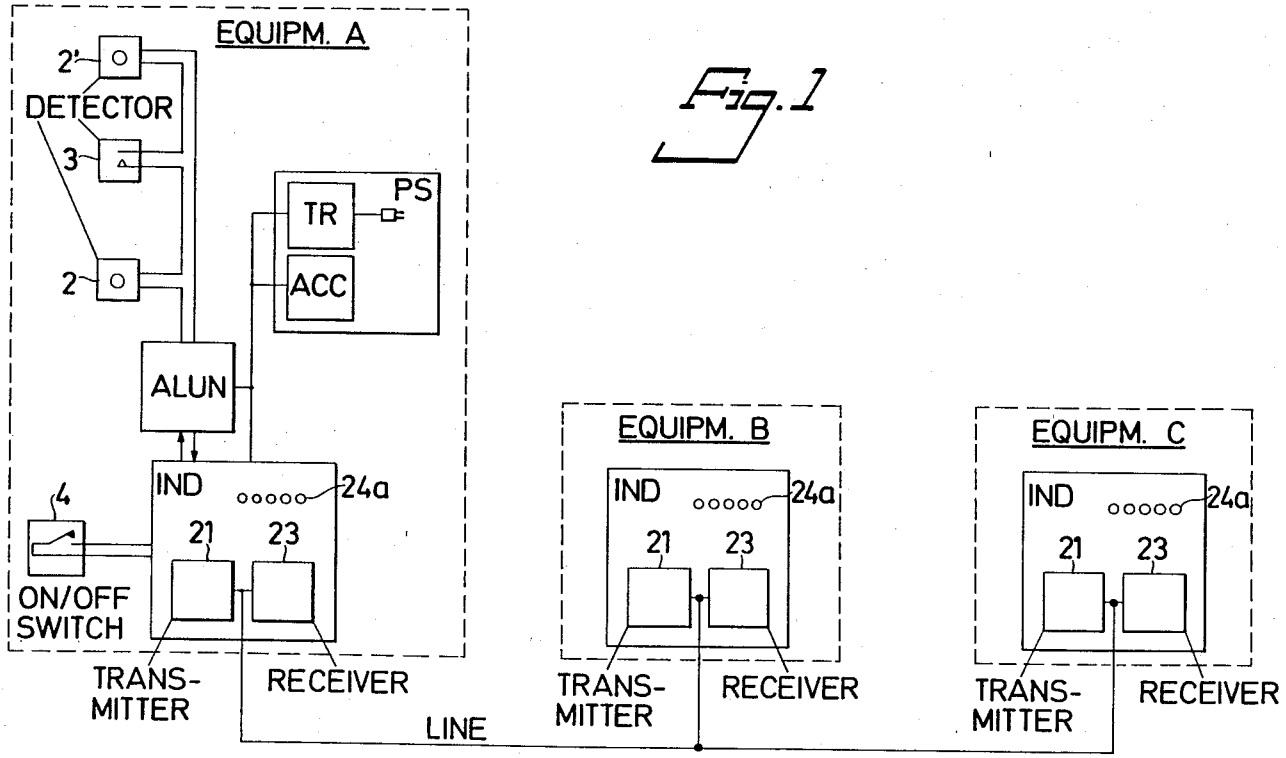
FIG. 1 discloses a function block diagram of the system.

The block diagram in FIG. 1 shows the equipments of three localities A, B and C. Due to the fact that the equipments, disregarding eventual differences with respect to the type and number of detectors which are used, have one and the same construction, the equipments positioned in the localities B and C have been represented by their respective indication devices IND. The disclosed group comprises three localities but obviously the system may also cover a different number of localities, for example from 2 up to 20 as holds for the embodiment which is described below.

The equipments at the localities A, B, C are connected in parallel to the common channel which is realized by a 2-wire line L which may be arranged in the air or under the ground.

Further to said indication device IND, having a number of indicator means 1 shaped as light emitting diodes which have been disclosed by means of circles and an eventual switch which is adequately hidden and may be used for switching between e.g. an "indoor" and an "outdoor" position as is described below, the local equipment comprises an alarm unit ALUN, an alarm loop having alarm detectors 2, 2', 3 and being connected to said ALUN, and a power source PS.

Said ALUN is of a type which is commonly used on the market and comprises a relay which is activated when anyone of said alarm detectors is initiated. Then a holding current loop is activated which keeps the relay in its activated state. Via a pair of contacts of the relay a direct voltage level indicating an alarm condition is supplied to IND (alarm indicative signal LARM, see FIG. 2). Via a different contact pair an activating current loop of a horn may be activated as is done in one type of the prior art systems described above. However the system according to the invention uses no horn. ALUN may be restored by means of a switch 4 for braking the holding current loop of the relay.

The power source PS comprises a low voltage transformer TR and an accumulator ACC which is maintenance charged by TR. ACC functions as a stand by power source if and when the mains breaks down. PS supplies current to IND and said alarm loop and its alarm detectors via the ALUN.

Said alarm detectors 2, 2' are so called ultra sonic detectors of a commonly known type, 3 is a so called window switch. The alarm loop may comprise also alarm detectors of other types, for example pressure sensitive switches, fire detectors, etc.

Figure 2:
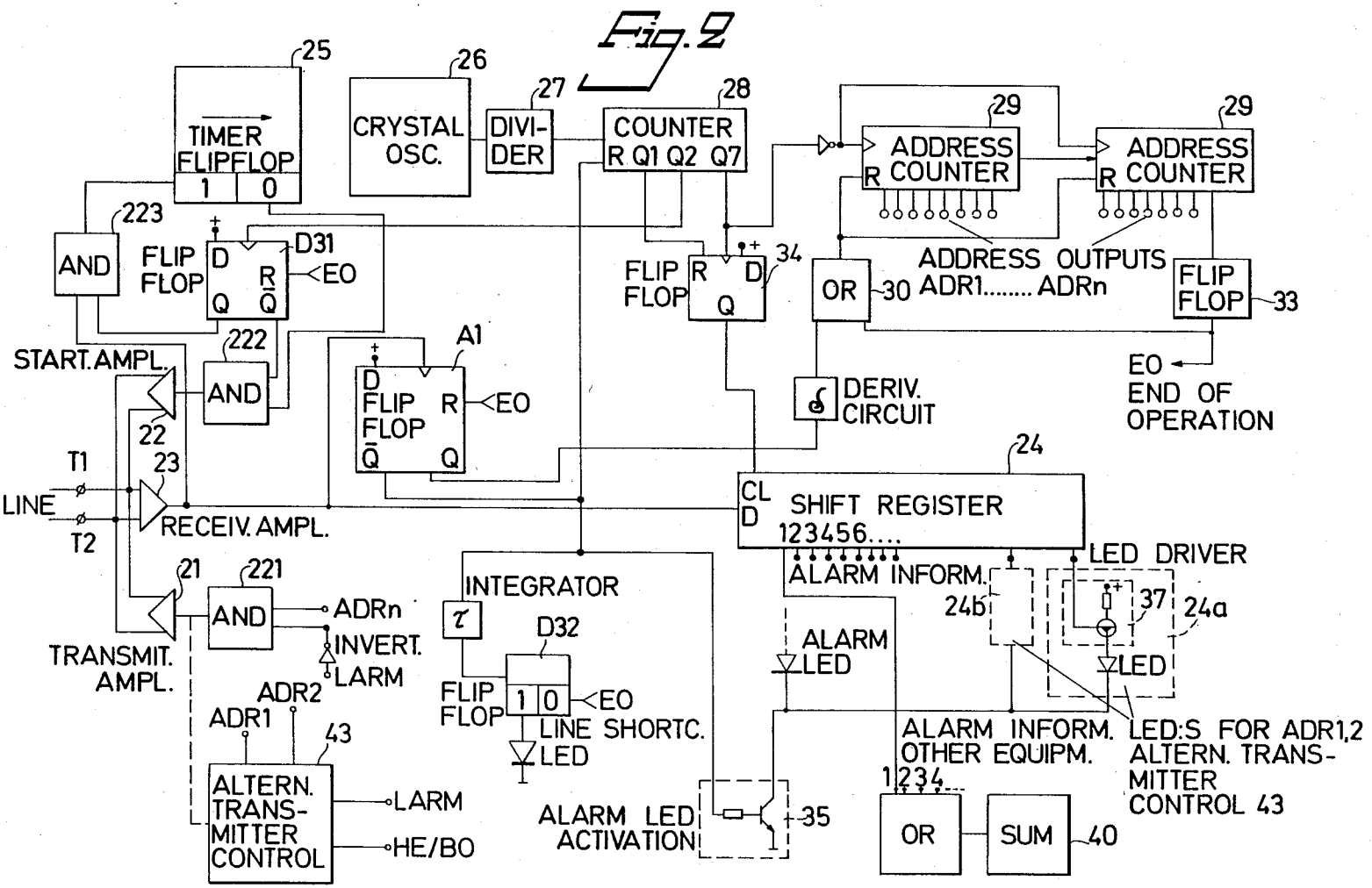
FIG. 2 discloses the circuit diagram of the indication device which is included in each local equipment, and FIG. 3 discloses a diagram of signals appearing at different points in the circuit diagram of FIG. 2.
Figure 5:
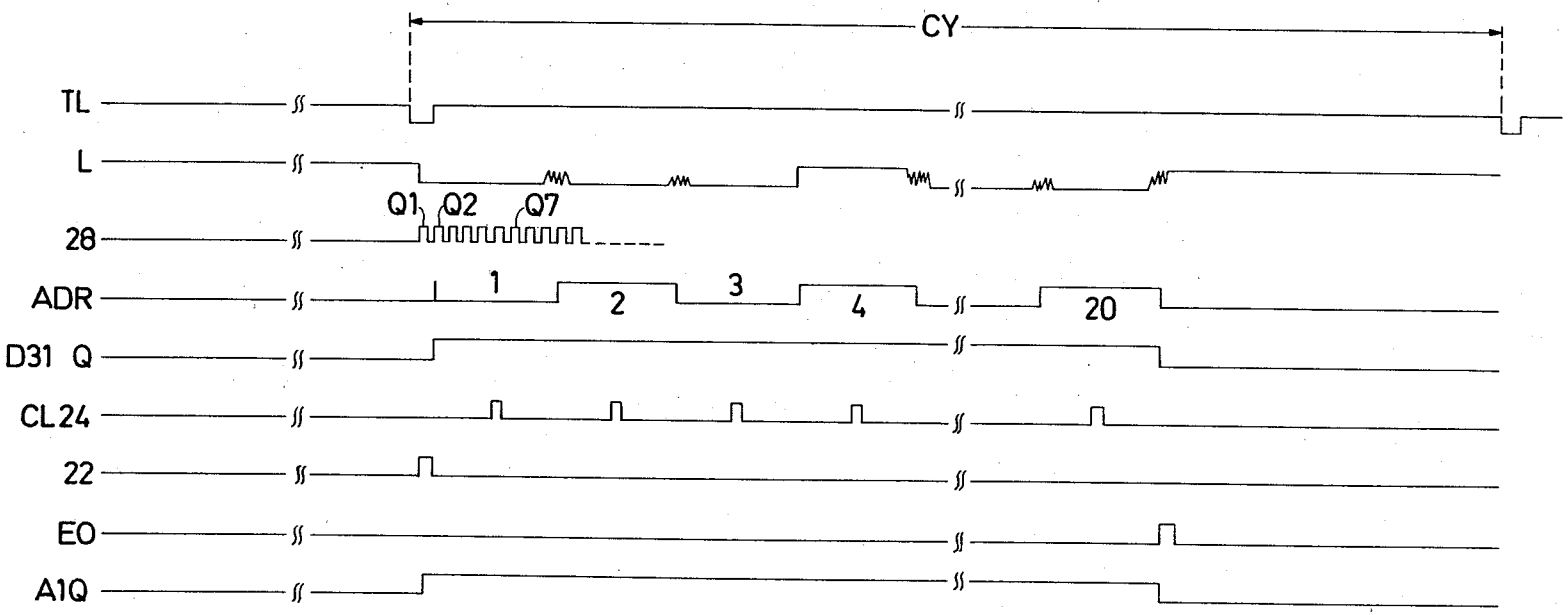

FIG. 2 shows the circuit diagram of IND. The 2-wire line L is connected to the terminals T1 and T2. In parallel with T1, T2 are connected two amplifiers 21, 22 for short-circuiting/not short-circuiting L dependent on a control information received from control circuits (see below). The amplifier 21 is comprised in the transmitter of the IND, and 22 is comprised in a starting circuit for the initiation of a sensing cycle, i.e. a transmission/-reception cycle.

To T1, T2 is also connected a third amplifier 23, having its output connected to a shift register 24, having in this embodiment the length of 20 bits. 23 is the receiver of the IND and the information which is received is temporarily stored in 24 for the control of the indicator means 24*a*, 24*b*, . . . and its light emitting diodes LED.

IND operates cyclically. The cycle is initiated by a timer circuit 25, which after ending of a holding signal changes from an "1"-state to a "0"-state. The operation frequency during the cycle is controlled by the crystal clock circuit 26 the output frequency of which is divided in the division circuit 27 before it is supplied to a counter 28, which is used as a generator of control pulses.

The high frequency (for example 3,6 MHz) crystal controlled clock circuit 26 has a most accurate frequency, which allows for a so called bit asynchronous mode of operation within the group and eliminates the need of synchronization between the local equipments during the cycles, and means that a cycle may be initiated by said timer circuit 25 only. This simplifies the construction of the equipments.

Further to said timer circuit or "timer flip-flop" 25 and said amplifier 22, the starting circuit comprises a D flip-flop D31 and two AND-gates 222 and 223. The output of the AND-gate 222 is connected to the input of the amplifier 22, and the inputs thereof are connected to the "0"-output of 25 and the $\overline{Q}$-output of said D31 respectively. One input of the AND-gate 223 is connected to the output of the receiver amplifier 23 and the second input thereof is connected to the Q-output of D31 and its output is connected to the "1"-input of 25. The D-input of D31 is connected to a positive voltage and to its reset input R is supplied an "end of operation"-signal EO, which is generated at the end of each cycle, and the triggering signal input of D31 is connected to an output Q2 of the counter 28, including seven series-connected bistable flip-flops.

The starting circuit functions as follows. When said EO pulse appears (see FIG. 3) the flip-flop D31 is reset to zero and thereby one input signal of the AND-gate 223 will go low and thereby the circuit 25 will start its transition from the "1" to the "0"-state. When this "0"-state is obtained, both of the input signals to the AND-gate 222 will go high, from which follows that the amplifier 22 becomes activated and short-circuits the line L (see signal L in FIG. 3). This short circuit state of the line is sensed by the receiver amplifier 23, which then triggers the D-flip-flip A1. Thereby the reset signal which is supplied to the counter 28 is eliminated and at the same time an address counter 29 is reset to zero for a short time by means of the Q-output signal of said flip-flop via a derivation circuit δ and an OR-gate 30. When counter 28 supplies an output signal on its output Q2, this signal triggers the flip-flop D31 and thereby the output signal from the AND-gate 223 becomes high and resets and maintains thereafter the circuit 25 in its "1"-state (see signal TL in FIG. 3).

In this situation a cycle has been initiated in the system. Quite independently of which one of the time controlled flip-flops 25 of the different local equipments that first switches to its "0"-state, a progress which is one and the same will thereafter take place in all local equipments because this progress is initiated by the shortcircuiting of L, which in turn is sensed by the receiver amplifier of all equipments.

After the described starting sequence the counter 28 and the address counter 29 take over the control of the cycle.

The address counter 29 has so called decoder outputs, which means that said outputs will successively supply an output signal in turn of order when the counter runs through its operation cycle, which in this embodiment comprises 20 advancements. The address output signals from the address counter 29 is used for the individualization of the local equipments of the group. This is obtained by means of a simple plug connecting one of the outputs of the address counter to one input of the AND-gate 221 to the second input of which is supplied the signal "not alarm", that is the inverted value of the alarm indicative signal LARM, and the output signal of which controls the transmitter amplifier. Thereby is obtained in the normal condition when there is no alarm, that the transmitter amplifier 21 may shortcircuit the line L during the time interval when its own address is supplied from the address counter 29. Vice versa the line L will not be shortcircuited during the same interval in case an alarm indicative signal LARM appears in the local equipment.

The shift register 24 is used for the reception of the signal condition on the line L during the respective address intervals of each cycle. For feeding of informations from the receiver amplifier 23 into the register 24 a clock pulse is used which is generated by means of a D-flip-flop 34 having its D-input connected to a positive voltage (+), its reset input R connected to the output Q1 of the counter 28, its triggering signal input connected to the output Q7 of the counter 28 and having its Q output connected to the clock signal input of the register 24. By means of this coupling mode is obtained that a clock pulse (CL 24) will be generated centrally during each address interval (compare signals CL 24 and ADR in FIG. 3). Thereby is obtained that the signal conditions on the line during the respective address intervals are successively supplied into the shift register 24. At the end of the cycle the shift register 24 comprises a line state information of each local equipment in a position of the register which corresponds to the address number of the local equipment in the address counter 29. This information in the register 24 is supplied to the driver circuits 37 of the corresponding indicator means LED which are connected to the respective outputs of the shift register.

At the end of the cycle said EO signal is generated by means of the output signal which is supplied from the last stage of the address counter 29 and a D-flip-flop 33. Said E0 pulse resets the flip-flop A1, the Q output of which then goes high which brings the activation circuit 35 of the indicator means to a conductive state. Thereby those of the light emitting diodes will be illuminated for which the shift register 24 comprises a "1", which means that the line L was not shortcircuited during the corresponding address interval and consequently that an alarm has been initiated in the corresponding equipment. Accordingly, by certifying if one or more of the light emitting diodes have been illuminated it is possible to read directly the localities in which an alarm has been initiated.

Said EO pulse simultaneously initiates the next following cycle by eliminating, as mentioned above, the holding signal of the time controlled flip-flop 25. The cycles may be repeated with such a repetition frequency that a light emitting diode emits a light which is apparently stable.

As mentioned above the alarm system according to this embodiment is continuously activated in the sense that the state of the line L is sensed repeatedly. If for example the line L should be broken alarms will consequently be indicated on both sides of the break, that is for the localities of the group which are situated at one side of the break alarms will be indicated in all of the localities situated on the opposite side of the break and vice versa. From this follows that the break may be recognized with a short delay and that the position of the break may be localized. If an error should appear in anyone of the local equipments this may lead to the situation that this equipment is not able to shortcircuit the line durings its address interval and thereby the locality is alarmed and measures may be taken.

For indicating a shortcircuit of the line L which is of a duration which covers several cycles, the indication device is provided with a D-flip-flop D32 the "1"-output of which controls the activation of a specific light emitting diode LED. This diode has its own position on the indication device and when this diode is illuminated a so called line alarm is indicated. The flip-flop D32 is controlled by the output signal $\overline{Q}$ from the flip-flop A1 via an integrator $\tau$. The EO pulse is supplied to the reset input of this flip-flop. In the normal condition the flip-flop is reset at the end of each cycle by the E0 pulse, and thereby the integrator will not reach an output signal level which is sufficient for setting of the flip-flop to its "1"-state. When the line L is shortcircuited during a number of cycles the EO pulse will not appear and therefore the integrator will reach a level which is sufficient for setting the flip-flop to its "1"-state and thereby to activate LED and initiate said line alarm.

FIG. 2 further shows a summer 40 which may be activated via an OR-gate having its respective inputs connected to those outputs of the shift register 24 which correspond to the remaining local equipments. From this follows that said summer will be activated when an alarm is initiated by the remaining local equipments of the group but not by an alarm in its own equipment.

FIG. 3 discloses a signal diagram for signals appearing at different points of the circuit diagram in FIG. 2. To some extent said signals have already been dealt with in the description of FIG. 2.

The signal TL is the output signal from the time controlled flip-flop 25 and shows a short break which initiates the cycle CY. The TL signal may be the output signal from said flip-flop of anyone of the equipments of the group.

The signal L illustrates the signal state on the line L. In the normal condition the signal state on the line should be low during that part of the cycle CY (see the signal TL) under which the address counter 29 is operative (compare signal ADR). However, for the purpose of illustration a high signal level is shown during the fourth address interval, which means that an alarm has been initiated in the equipment having this address interval.

28 represents the input signal which is supplied to the counter 28, and the pulse frequency is in reality substantially higher than what appears from the diagram. Within the pulse sequence the output signals from the stages Q1, Q2 and Q7 of the counter have been shown.

ADR represents the address intervals 1–20 which are generated by the address counter 29.

D31Q represents the output signal appearing at the Q output of the flip-flop D31. This output signal goes high when the Q2 output of the counter 28 supplies an output signal and thereby resets the flip-flop 25 to its "1"-state (see signal TL).

The signal CL represents the clock pulse signal which is supplied to the receiver register 24, the clock pulses of which appear centrally within each adress interval generated by the counter 29.

22 shows the input signal to the amplifier 22, which is included in the starting circuit. This input signal is reset by means of the flip-flop 31 in a way which corresponds to the resetting of the flip-flop 25 (see signal TL). The pulse signal 22 appears only in that one of the equipments which initiates the cycle.

E0 represents the "end of operation" pulse which is generated at the end of each cycle by the D flip-flop 33 which is connected to the last stage of the address counter 29.

A1Q represents the output signal supplied from the Q-output of the flip-flop A1. This output signal is high during all address intervals but goes low when influenced by the EO pulse. When this signal goes low the activation circuit 35 of the light emitting diodes becomes conductive by the Q output signal from the same flip-flop, and thereby those light emitting diods LED are illuminated for which an alarm is valid according to the contents of the shift register 24. Thereafter such a light emitting diode will be illuminated during a meantime interval up to the point when the time controlled flip-flop 25 of anyone of the equipments will again change states and thereby initiate a next following cycle.

At the bottom of FIG. 2 an alternative circuit for control of transmitter amplifier 21 is disclosed. This circuit is controlled by two addresses obtained from 29, that is ADR1, ADR2, the signal LARM and an indoor-/outdoor HE/BO signal which is generated by the switch 4 in FIG. 1, that is a signal which indicates whether or not the supervisory function of a local equipment has been activated. Corresponding to said two addresses each equipment have two indicator LED: s of the set 24*a*, 24*b*, . . . Thereby the condition alarm/not alarm may be indicated by its one LED and the condition indoor/outdoor by its other LED, which simplifies the use thereof by indicating also the local equipments of which the detector has been activated, and thereby indirectly where people may be expected to be indoor and may be reached on telephone for checking the alarm before the police is called for in case an alarm is initiated by the system. If desireable the same set of LED: s may be used for both indications by introduction of a manual switch in one state of which a LED indicates alarm/not alarm and in the other state of which the same LED indicates indoor/outdoor.

The embodiment disclosed in this specification uses a type of time-multiplex transmission on the common channel. It is obvious that a frequency-multiplex transmission may be used as well and then each local equipment may have its own tone frequency signature signal which is generated in control of the accurate oscillator 26. The respective signature signals may be separated by filtering.

If desirable the indication devices may be provided with a manual switch by means of which an alarm, being indicated by a LED and a summer tone, may be acknowledged. For example, by operating said switch the lighted LED may turn from a state of stable light to a state of twinkling light or vice versa and the summer may be disabled from further activation by the actual alarm indication but instaed ready for activation by an eventual further alarm. By this feature the system according to the invention may give an improved indication of several alarms from different localities.

We claim:

1. A protective system for a plurality of sites, like homes, each having local apparatus in communication with corresponding local apparatus in the other of said plurality of sites, said local apparatus at a given site comprising:

detector means for sensing an abnormal condition;

means for generating an identification signal unique to said given site;

means coupled to said detector means for modifying said identification signal in response to the detection of an abnormal condition;

transmitter means coupled to said generating means and said modifying means for transmitting a site identification signal to the other sites, said site identification signal being a combination of the identification signal and the modified identification signal;

site recognition means obtaining said site identification signal from the other sites for identifying each of said plurality of sites from its identification signal;

determining means coupled to said recognition means for generating an alarm signal in response to a modified identification signal and for associating the abnormal condition with the particular one of said sites where it occurred;

indicator means coupled to said recognition means and said determining means for displaying the condition of each of said sites; and control means for repeatedly initiating at preset intervals a cycle of generating an identification signal for said given site with said generating means, modifying such identifiation signal with said modifying means when an abnormal condition is detected at said given site, transmitting said site identification signal with said transmitter means, obtaining identification signals from others of said sites with said site recognition means, determining an abnormal condition in any of said sites with said determining means, and displaying the condition of each of said sites with said indicator means.

2. The system of claim 1, wherein said indicator means comprises an indicator, an integrator coupled to a signal source, reset means for returning said integrator to zero at preset intervals under normal conditions, and a threshold sensing means coupled to said integrator for generating an actuating signal to said indicator when the integrator output exceeds a predetermined level.

3. The system of claim 2, wherein said site recognition means comprises means for establishing assigned respective time periods for transmitting and receiving the identification signal from a given site.

4. The system of claim 3, wherein said modifying means comprises means for altering said identification signal during said assigned time period.

5. The system of claim 4, wherein said indicator means comprises a shift register for storing said site identification signals in respective register positions, and a display device coupled to each of said shift register positions.

6. The system of claim 5, wherein said generating means comprises an oscillator connected to a pulse generator having its output coupled to a counter means arranged for defining the time duration of said cycle, said counter means having successive counter positions for supplying an output signal from each position during said cycle, each of said counter positions corresponding to an associated site, said counter means generating an actuating signal for a particular site only when the counter is at the associated counter position.

7. The system of claim 6, wherein said sites are in communication by wire and wherein said generating means comprises means for shortcircuiting the line in response to said actuation signal under normal conditions.

8. The system of claim 7, wherein said modifying means comprises blocking means to prevent the shortcircuiting means from shortcircuiting the wire in response to an abnormal condition.

9. The system of claim 1, wherein said indicator means comprises a shift register for storing said site identification signals in respective register positions, and a display device coupled to each of said shift register positions.

10. The system of claim 1, wherein said generating means comprises an oscillator connected to a pulse generator having its output coupled to a counter means arranged for defining the time duration of said cycle, said counter means having successive counter positions for supplying an output signal from each position during said cycle, each of said counter positions corresponding to an associated site, said counter means generating an actuating signal for a particular site only when the counter is at the associated counter position.

11. The system of claim 10, wherein said sites are in communication by wire and wherein said generating means comprises means for shortcircuiting the line in response to said actuation signal under normal conditions.

12. The system of claim 11, wherein said modifying means comprises blocking means to prevent the shortcircuiting means from shortcircuiting the wire in response to an abnormal condition.

* * * * *